US008270889B2

(12) United States Patent
Sambhy et al.

(10) Patent No.: US 8,270,889 B2
(45) Date of Patent: Sep. 18, 2012

(54) LOW ADHESION COATINGS FOR IMAGE FIXING

(75) Inventors: Varun Sambhy, Webster, NY (US); Dale R. Mashtare, Bloomfield, NY (US); Kock-Yee Law, Penfield, NY (US); Rachel L. McGrath, Churchville, NY (US)

(73) Assignee: Xerox Corporation, Norwalk, CT (US)

( * ) Notice: Subject to any disclaimer, the term of this patent is extended or adjusted under 35 U.S.C. 154(b) by 204 days.

(21) Appl. No.: 12/855,140

(22) Filed: Aug. 12, 2010

(65) Prior Publication Data

US 2012/0039648 A1 Feb. 16, 2012

(51) Int. Cl.
*G03G 15/20* (2006.01)

(52) U.S. Cl. ..... 399/333; 399/328

(58) Field of Classification Search ..... 399/333, 399/330, 329, 328; 347/156; 430/124.1, 430/124.3, 124.32
See application file for complete search history.

(56) References Cited

U.S. PATENT DOCUMENTS

2009/0041516 A1* 2/2009 Fukaya ..... 399/333
2009/0324308 A1* 12/2009 Law et al. ..... 399/333
2011/0122210 A1* 5/2011 Sambhy et al. ..... 347/101
2011/0298866 A1* 12/2011 Casella et al. ..... 347/45

* cited by examiner

*Primary Examiner* — Sophia S Chen
(74) *Attorney, Agent, or Firm* — MH2 Technology Law Group LLP

(57) ABSTRACT

Various embodiments provide low adhesion coatings that can be used for an image-side member in an image fixing system of an electrophotographic printer or an ink jet printer, wherein the low adhesion coatings can exhibit a low sliding angle ranging from about 1° to about 30° with a solid ink, a toner, hexadecane and/or water.

20 Claims, 4 Drawing Sheets

LOW ADHESION COATINGS FOR IMAGE FIXING

RELATED APPLICATION

Reference is made to co-pending, commonly assigned:

U.S. patent application Ser. No. 12/855,011, entitled "Multi-Stage Fixing Systems, Printing Apparatuses and Methods of Fixing Marking Material to Substrates", filed Aug. 12, 2010;

U.S. patent application Ser. No. 12/855,036; entitled "Fixing Devices for Fixing Marking Material to a Web with Contact Pre-Heating of Web and Marking Material and Methods of Fixing Marking Material to a Web", filed Aug. 12, 2010;

U.S. patent application Ser. No. 12/855,054, entitled "Fixing Devices Including Low-Viscosity Release Agent Applicator System and Methods of Fixing Marking Material to Substrates", filed Aug. 12, 2010;

U.S. patent application Ser. No. 12/855,066, entitled "Fixing Devices Including Contact Pre-Heater and Methods of Fixing Marking Material to Substrates", filed Aug. 12, 2010;

U.S. patent application Ser. No. 12/855,078, entitled "Fixing Systems Including Image Conditioner and Image Pre-Heater and Methods of Fixing Marking Material to Substrates", filed Aug. 12, 2010; and U.S. patent application. Ser. No. 12/855,106, entitled "Fixing Devices Including Extended-Life Components and Methods of Fixing Marking Material to Substrates", filed Aug. 12, 2010; the disclosures of which are incorporated herein by reference in their entirety.

FIELD OF THE USE

The present teachings relate generally to coating compositions and, more particularly, to low adhesion coatings useful for image fixing systems in electrophotographic devices and ink jet marking devices.

BACKGROUND

Low temperature, moderate pressure fusing is a toner fusing methodology by exploiting a regime of applied pressures and temperatures to produce a high image quality output. This enables use of robust, long life subsystem components and reduced toner design complexity. The toner fusing methodology includes a multi-step, toner fusing process, in which the toner material is first softened on the print substrate. The softened toner layer is then subjected to a low temperature, moderate pressure nip to flow the softened toner layer to insure adequate coalescence and adhesion to the print substrate. By performing this toner fuse process as a multi-step process at low temperatures, burdens placed on the fusing subsystem components and the toner material design are alleviated.

As shown in FIG. 1, the low temperature, moderate pressure fusing process includes first pre-heating a print substrate 12 with unfused toner particles 14 thereon, and then forming a pressure nip between a fuser roll 10 and a pressure roll 30 in order to fuse the unfused toner particles 14 onto the print substrate 12.

The toner softening step may be practiced in various manners including chemical, mechanical, thermal, or other means to invoke a viscoelastic toner softening. For example, toner softening has been achieved by heating the toner layer through a non-contact warming zone using a radiant heating device. As a result, the toner/substrate interface is heated to temperatures above the glass transition temperature or melting temperature of the toner, softening the toner material. The softened toner image is then passed through a robust pressure nip region to coalesce the toner image and to insure adequate adhesion to the substrate. Conventional pressure nip is formed between an anodized aluminum roll 10 and a polyurethane pressure roll 30, with the toner contacting surface operated at the same or similar surface temperature to that of the heated/softened toner layer.

However, as known in the art, toner materials have high adhesion to Al surfaces that result in substantial toner offset (see 25 in FIG. 1) to the Al surface of the fuser roll 10 during the fusing process.

Conventional solutions to solve this toner offset problem include applying a release agent or oil to the Al roll surface to facilitate toner release as shown in FIG. 1. For example, a release management subsystem 40 is used to apply the release layer. Specifically, the release management subsystem 40 includes a sump 20 containing a polymeric release agent 22 which may be a solid or liquid at room temperature, but is a fluid at operating temperatures. For applying the polymeric release agent 22 to the outer surface of the fuser roll 10, two release agent delivery rolls 17 and 19 are rotatably mounted in a direction to transport release agent 22 from the sump 20 to the fuser surface. As illustrated in FIG. 1, roll 17 is partly immersed in the sump 20 and transports the release agent from the sump to the delivery roll 19. By using a metering blade 24, a layer of polymeric release oil can be applied initially to the delivery roll 19 and subsequently to the outer surface of the fuser roll 10 in a controlled thickness of about 0.1 to 2 micrometers, or greater.

However, even with the release layer, toner offset to Al surfaces still occurs at temperatures near the operating setpoints. In fact, significant toner offset to the Al surfaces is observed for both wax-containing toner materials and wax-less toner materials.

Thus, there is a need to overcome these and other problems of the prior art and to provide low adhesion materials useful for fixing members.

SUMMARY

According to various embodiments, the present teachings include an image fixing system. The image fixing system can include a pressure member in contact with an image-side member, which are configured to pass a print medium therebetween and to fix an image on the print medium. The image-side member can include a substrate, and an outermost layer disposed over the substrate. The outermost layer can include a low adhesion coating having a low sliding angle ranging from about 1° to about 30° with at least one imaging material selected from the group consisting of a solid ink, a toner, hexadecane and water.

According to various embodiments, the present teachings also include another image fixing system. This image fixing system can include a pressure member in contact with a low temperature, moderate fuser member and configured to pass a print medium between the pressure member and the low temperature, moderate fuser member, and to fix an image on the print medium. The contact between the pressure member and the low temperature, moderate fuser member can have a nip pressure ranging from about 300 Psi to about 3000 Psi at a temperature of about 150° C. or less. The low temperature, moderate fuser member can include a substrate, and an outermost layer disposed over the substrate. The outermost layer can include a low adhesion coating having a low sliding angle ranging from about 1° to about 30° with a toner including a wax-containing toner or a wax-less toner.

According to various embodiments, the present teachings further include an additional image fixing system. This image fixing system can include a pressure member in contact with a spreader member configured to pass a print medium therebetween and to fix an image on the print medium. The contact between the pressure member and the spreader member can have a nip pressure ranging from about 300 Psi to about 3000 Psi at a temperature of about 150° C. or less. The spreader member can include a substrate, and an outermost layer disposed over the substrate. The outermost layer can include a low adhesion coating having a low sliding angle ranging from about 1° to about 30° with an ink.

It is to be understood that both the foregoing general description and the following detailed description are exemplary and explanatory only and are not restrictive of the present teachings, as claimed.

BRIEF DESCRIPTION OF THE DRAWINGS

The accompanying drawings, which are incorporated in and constitute a part of this specification, illustrate several embodiments of the present teachings and together with the description, serve to explain the principles of the present teachings.

It should be noted that some details of the figures have been simplified and are drawn to facilitate understanding of the embodiments rather than to maintain strict structural accuracy, detail, and scale.

DESCRIPTION OF THE EMBODIMENTS

Reference will now be made in detail to embodiments of the present teachings, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the present teachings may be practiced. These embodiments are described in sufficient detail to enable those skilled in the art to practice the present teachings and it is to be understood that other embodiments may be utilized and that changes may be made without departing from the scope of the present teachings. The following description is, therefore, merely exemplary.

Various embodiments provide low adhesion coatings that can be used for an image-side member in an image fixing system of an electrophotographic printer and/or an ink jet printer. The low adhesion coatings can exhibit a low sliding angle with a material including, for example, molten toner, a solid ink, hexadecane and/or water. In embodiments, the image-side member can be configured in contact with a pressure member for a print medium to pass between the image-side member and the pressure member. Unfixed images on the print medium can then be fixed on the print medium.

As disclosed herein, the image-side member can be a printer member configured along a moving path of a print medium. It can contact unfixed or unspread images on the moving print medium to facilitate the image-fixing on the print medium. The printer can be an electrophotographic printer or an ink jet printer. The image-side member can be, for example, a fixing member, a fuser member, a spreader member, a pressure member, a heat member, and/or a donor member.

In one embodiment, the image-side member can be a fuser member configured in a fusing system for transfixing unfixed toner images on the print medium. In another embodiment, the image-side member can be a spreader member configured in a direct-to-sheet spreader system for spreading jetted ink images on the print medium. Toner offset or ink offset can be eliminated from the image-side member due to use of the low adhesion coatings, as disclosed herein.

Figure 2A:
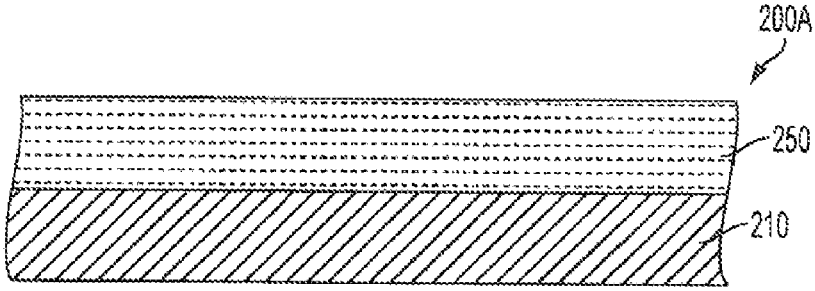
FIGS. 2A-2C depict a portion of various exemplary image-side members in accordance with various embodiments of the present teachings.
Figure 2B:
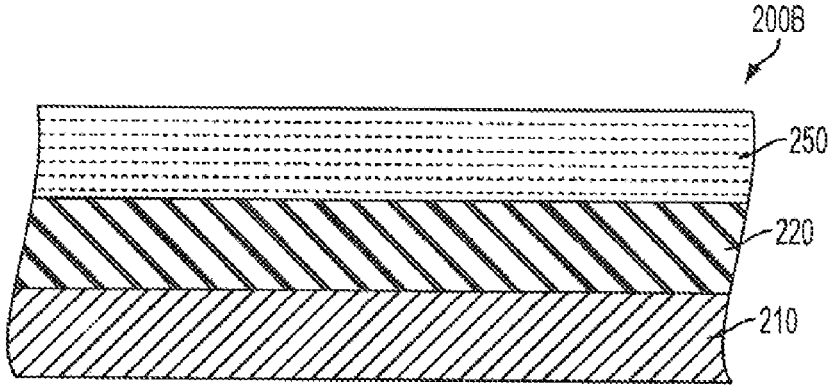
Figure 2C:
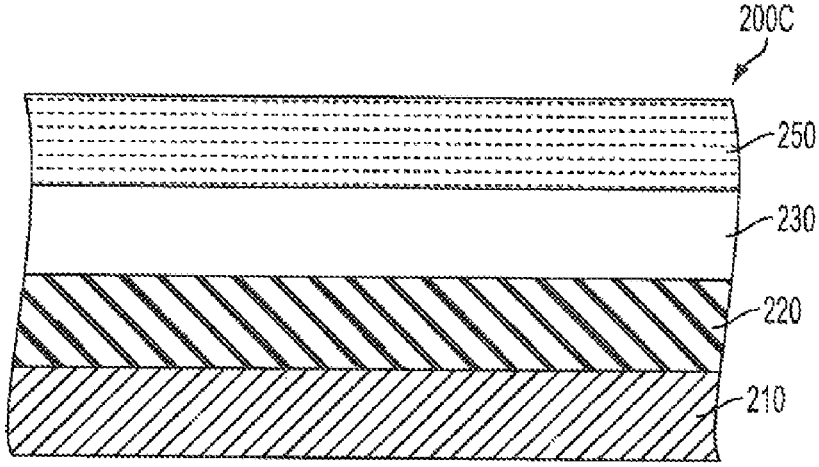

FIGS. 2A-2C depict a portion of various exemplary image-side members 200A-200C in accordance with the present teachings. It should be readily apparent to one of ordinary skill in the art that the member depicted in FIG. 2A, 2B, or 2C represents generalized schematic illustration and that other components/layers can be added or existing components/layers can be removed or modified.

As shown, the image-side member 200A of FIG. 2A can include a substrate 210 and a low adhesion coating 250 used as an outermost layer disposed over the substrate 210.

In various embodiments, one or more other functional layers can be disposed between the substrate 210 and the low adhesion coating 250. For example, the low adhesion coating 250 can be formed over a resilient layer 220, for example a silicone rubber layer, that is formed over the substrate 210 as shown in FIG. 2B. In another example, an interfacial layer 230 may further be disposed between the resilient layer 220 and low adhesion coating 250 as shown in FIG. 2C.

The substrate 210 of FIGS. 2A-2C can be formed of a variety of materials, such as, for example, metals, metal alloys, rubbers, glass, ceramics, plastics, or fabrics. The metals can include aluminum, anodized aluminum, steel, nickel, copper, and mixtures thereof, while the plastics can include polyimide, polyester, polyetheretherketone (PEEK), poly (arylene ether), polyimide, and mixtures thereof.

The substrate 210 can be in a form including, but not limited to, a cylinder, a roller, a belt, a plate, a film, a sheet, a drum, and/or a drelt (cross between a belt and a drum). In certain embodiments, the image-side member 200A-C can be a belt substrate or a roll substrate. The thickness of the substrate 210 in a belt configuration can range from about 50 μm to about 300 μm, or from about 50 μm to about 200 μm, or from about 50 μm to about 100 μm. The thickness of the substrate 210 in a cylinder or a roll configuration can range from about 2 mm to about 20 mm, or from about 3 mm to about 15 mm, or from about 3 mm to about 10 mm.

The low adhesion coating 250 can be used as an outermost layer formed over the substrate 210 for the image-side member 200A-C. In embodiments, on a surface of the low adhesion coating 250, a ~10-15 μL water-based or oil-based drop can tend to bead up and can have a sliding angle with the low adhesion coating surface.

As used herein, the term "low adhesion" refers to a low sliding angle of a water-based or oil-based drop with a low adhesion coating surface, wherein the low sliding angle can be less than about 30°, for example, ranging from about 1° to about 30°, or from about 25° to about 30°, or from about 1° to about 20°, or from about 1° to about 15°, when measured with the oils (e.g., hexadecane), water, and/or imaging materials including wax-containing toner materials, wax-less toner materials, organic inks, and/or aqueous inks.

For example, the low adhesion coating 250 can exhibit low adhesion to imaging materials including toner patches or jetted ink drops, as measured by a low sliding angle such that fused toner images or spread ink images can be released from the low adhesion coating surface after the fusing or spreading process, leaving no toner or ink residue on the image-side member 200A-C.

The low adhesion coating 250 can have an oil contact angle of at least about 30° with exemplary oils of hexadecane, dodecane, hydrocarbons, organic-based ink including solid ink and UV ink, etc. For example, the low adhesion coating 250 can have a contact angle with solid ink and toner of at least about 40°. The low adhesion coating 250 can also have a water contact angle of at least about 90°.

The disclosed low adhesion coating 250 can be prepared to include, for example, Component A, B, C and/or D. In embodiments, Component A of the low adhesion coating 250 can include any suitable polymer or oligomer containing hydroxyl (—OH) functional groups. For example, Component A can be selected from the group consisting of hydroxyl functional polymers or oligomers such as polyvinyls, polystyrenes, polyacrylates, polyesters, polyethers, and mixtures thereof. In a specific embodiment, Component A can be a hydroxyl functional polyacrylate resin sold under the name Desmophen® A 870 BA available from Bayer Materials Science.

Component B of the low adhesion coating 250 can include any suitable polymer or oligomer containing isocyanate (—NCO) functional groups. For example, Component B can be selected from the group consisting of isocyanate functional polymers or oligomers such as polyvinyls, polystyrenes, polyesters, polyacrylates, and mixtures thereof. In embodiments, the isocyanate can be selected from the group consisting of diphenylmethane diisocyanate, toluene diisocyanate, hexamethylene diisocyanate, isophorone diisocyanate, or suitable polymer or oligomer containing isocyanate (—NCO) functional groups, and mixtures thereof. In a specific embodiment, Component B can be a solvent free aliphatic isocyanate resin based on hexamethylene diisocyanate sold under the name Desmodur® N 3300 A available from Bayer Materials Science.

Component C of the low adhesion coating 250 can be any suitable hydroxyl functionalized polymer or oligomer containing polysiloxane units. For example, Component C can be selected from the group consisting of hydroxyl functionalized polymers or oligomers containing polysiloxane units such as polyvinyls, polystyrenes, polyacrylates, polyethers, and mixtures thereof. In a specific embodiment, Component C can be a polymer including polysiloxane side-chains on hydroxyl-functional polyacrylate backbone sold under the name BYK-Silclean® 3700 available from BYK Additives and Instruments.

Component D of the low adhesion coating 250 can be any suitable fluoro-crosslinking materials. In embodiments, the fluoro-crosslinking material can be a hydroxyl functionalized polymer modifier sold under the name Fluorolink® including, for example, Fluorolink-D®, Fluor® link-D10H®, Fluorolink-E10H®, or Fluorolink-S10® available from Solvay Solexis.

In one embodiment, the low adhesion coating 250 can be a low adhesion material that includes Components A, B, and C, wherein Component A can be a hydroxyl functionalized polyester, such as Desmophen® (available from Bayer Materials Science); Component B can be an isocyanate, such as Desmodur® or Bayhydur® (available from Bayer Materials Science); and Component C can be a hydroxyl functionalized polysiloxane crosslinking material, such as BYK-Silclean® (available from BYK Additives and Instruments).

In another embodiment, the low adhesion coating 250 can be a low adhesion material including Components A, B, and D, wherein Component A can be a hydroxyl functionalized polyester, such as Desmophen® (available from Bayer Materials Science); Component B can be an isocyanate, such as Desmodur® or Bayhydur® (available from Bayer Materials Science); and Component D can be a fluoro-crosslinking material Fluorolink® (available from Solvay Solexis).

In yet another embodiment, the low adhesion coating 250 can be a low adhesion material including Components A, B, C and D, wherein Component A can be a hydroxyl functionalized polyester, such as Desmophen® (available from Bayer Materials Science); Component B can be an isocyanate, such as Desmodur® or Bayhydur® (available from Bayer Materials Science); Component C can be a hydroxyl functionalized polysiloxane crosslinking material, such as BYK-Silclean® (available from BYK Additives and Instruments); and Component D can be a fluoro-crosslinking material Fluorolink® (available from Solvay Solexis).

In exemplary embodiments, the low adhesion coating 250 can be made by, for example, cross-linking a diisocyanate with a hydroxyl-functionalized polyester in a solvent in the presence of a hydroxyl functionalized polysiloxane crosslinking material. Alternatively, a fluoro-crosslinking material can be used. In certain embodiments, a mixture of a hydroxyl functionalized polysiloxane crosslinking material and a fluoro-crosslinking material can be used with the diisocyanate and the hydroxyl-functionalized polyester to form the low adhesion coating 250.

In embodiments, the low adhesion coating 250 can include a suitable polymer or oligomer containing one or more of, for example, an isocyanate functional group; a suitable polymer or oligomer containing a hydroxyl functional group; a suitable hydroxyl functionalized polymer or oligomer containing at least one polysiloxane unit; a hydroxyl functionalized fluoro-crosslinking material; and/or a mixture of an oligomer containing at least one polysiloxane unit and a hydroxyl functionalized fluoro-crosslinking material.

In some embodiments, the low adhesion coating 250 can include an isocyanate, a polylol, and a hydroxyl functionalized polysiloxane. In other embodiments, the low adhesion coating 250 can include an isocyanate, a polylol, and a hydroxyl functionalized fluoro-crosslinking material. In yet other embodiments, the low adhesion coating 250 can include an isocyanate, a polylol, a hydroxyl functionalized polysiloxane, and a hydroxyl functionalized fluoro-crosslinking material.

In embodiments, the components of the low adhesion coating 250 can be present in any suitable amount. For example, Component A can be present in an amount of from about 40 to about 80, or from about 50 to about 75, or from about 55 to about 70 weight percent based upon the total weight of the low adhesion coating 250. In other exemplary embodiments, the amount of Component A is not limited.

Component B can be present in an amount of from about 15 to about 50, or from about 20 to about 45, or from about 25 to about 40 weight percent based upon the total weight of the low adhesion coating 250. In other exemplary embodiments, the amount of Component B is not limited.

Component C can be present in an amount of from about 0.1 to about 15, or from about 1 to about 10 weight percent, or from about 2 to about 8 weight percent based upon the total weight of the low adhesion coating 250. In other exemplary embodiments, the amount of Component C is not limited.

Component D can be present in an amount of from about 0.01 to about 5, or from about 0.1 to about 3, or from about 1 to about 2 weight percent based upon the total weight of the low adhesion coating 250. In other exemplary embodiments, the amount of Component D is not limited.

In embodiments, a mixture of Component C and Component D can be used for optimizing the desirable surface adhesion to, for example, toner materials or jetted ink. In this case, Component C can be present in an amount of from about 0.1 to about 10, or from about 1 to about 8, or form about 2 to about 6 weight percent based upon the total weight of the low adhesion coating layer 250. Component D can be present in an amount of from about 0.01 to about 5, or from about 0.1 to about 4, or from about 1 to about 2 weight percent based upon the total weight of the low adhesion coating layer 250. In other exemplary embodiments, the amount of Component C and/or D is not limited.

The low adhesion coating 250 can be applied over the substrate 210 by any suitable method including, but not limited to, dip coating, spray coating, spin coating, flow coating, stamp printing, die extrusion coatings, and/or blade techniques. In exemplary embodiments, an air atomization device such as an air brush or an automated air/liquid spray can be used for spray coating. The air atomization device can be mounted on an automated reciprocator that moves in a uniform pattern to cover the surface of the substrate or other functional layer as shown in FIGS. 2A-2C with a uniform coating. In another example, a programmable dispenser can be used to apply the coating material to conduct a flow coating.

In embodiments, the low adhesion coating 250 can first be applied or disposed as a wet coating on the underlying layer, for example, the substrate 210, or the functional layer 220 or 230 of FIGS. 2A-2C. A drying or curing process can then be followed. In embodiments, the wet coating can be heat-cured at an appropriate temperature for the drying and curing, depending on the material or process used. For example, the wet coating can be heated to a temperature ranging from about 100° C. to about 200° C. for about 5 to about 180 minutes. In embodiments, after the drying and curing process, the low adhesion coating layer can have a thickness ranging from about 0.02 micrometer to about 10 micrometers, or from about 0.02 micrometer to about 5 micrometers, or from about 0.05 micrometer to about 3 micrometers.

The low adhesion coating 250 can be stable and used at a temperature of about 200° C. or less such as ranging from about 50° C. to about 200° C.; or ranging from about 70° C. to about 150° C. In embodiments, the low adhesion coating 250 can be used at a pressure ranging from about 300 Psi to about 3000 Psi, or ranging from about 300 Psi to about 2000 Psi, or ranging from about 500 Psi to about 2000 Psi.

Figure 3:
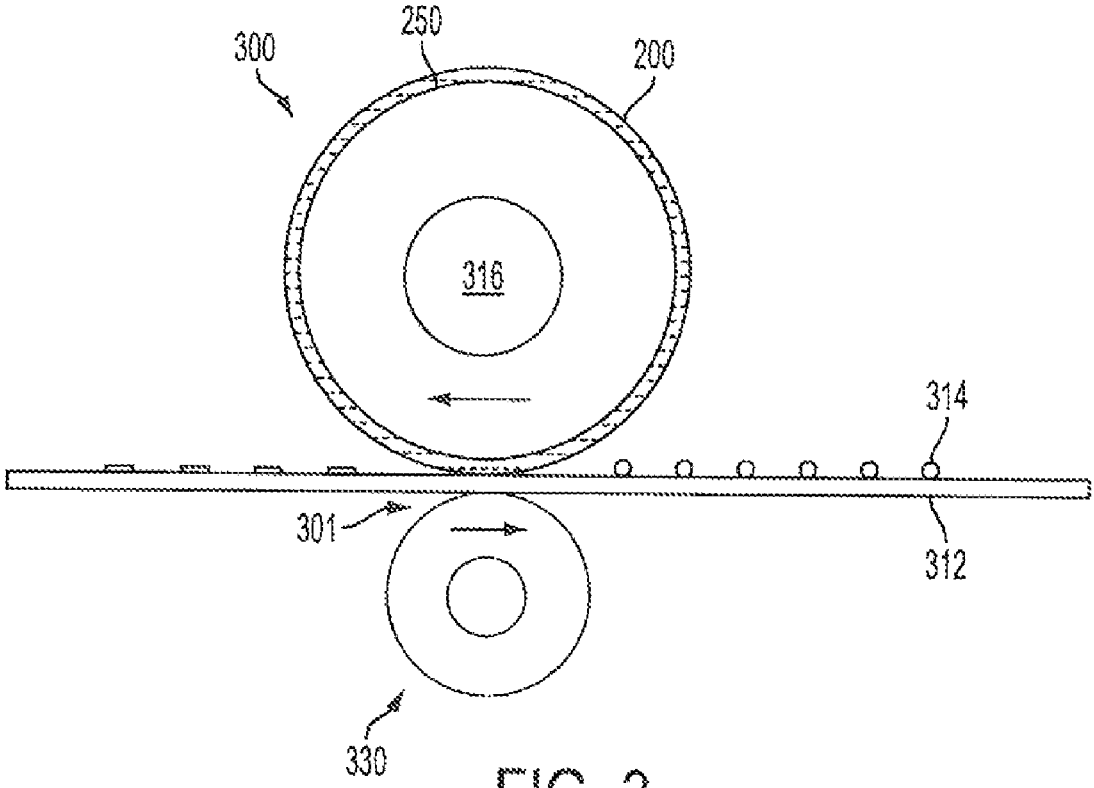
FIG. 3 is a sectional view of an exemplary image fixing system without using a release management subsystem in accordance with various embodiments of the present teachings

FIG. 3 is a sectional view of an exemplary image fixing system 300 without using a release management subsystem in accordance with various embodiments of the present teachings. Note that although the image-side member 200 shown in FIG. 3 depicts in a roll form, one of ordinary skill in the art would understand that the disclosed image-side member 200 can be in a form of a belt, a plate, a film, a sheet, a drum, a drelt (cross between a belt and a drum), or other known form for a fuser member or a spreader member.

As shown, the system 300 can include an image-side member 200, for example, the image-side member 200A-C in FIGS. 2A-2C. The image-side member 200 can include a heating element 316 disposed in its hollow portion. A pressure roll 330 can cooperate with the image-side member 200 to form a nip or contact arc 301 through which a print medium 312 (e.g., a copy paper) passes, such that unfixed images 314, for example, unfused toner patches or unspread ink images, on the print medium 312 can contact the outer surface of the image-side member 200, i.e., contact the surface of the low adhesion coating 250. In embodiments, the pressure roll 330 can include, for example, a rigid metal (e.g., steel) core with a soft surface layer as known in the art, or can include the disclosed low adhesion coating applied on the rigid metal core or applied on the conventional soft surface layer, although the assembly is not limited thereto.

During operation, the print medium 312 can be a moving print medium. In embodiments, a predetermined pressure, and in some implementations, heat, can be applied to the moving print medium by the image fixing system 300 to fuse toner images or to spread ink images on the print medium 312. In embodiments, image permanence can be improved by increasing image cohesion and/or by increasing the adhesion between the image and the print medium.

In some embodiments, the image fixing system 300 can be a fusing system, for example, a low temperature, moderate pressure fusing system, and the image-side member can be a fuser member. The fuser member having an outermost layer of the disclosed low adhesion coating can allow the fusing to be processed at a temperature of less than about 150° C., for example, ranging from about 50° C. to about 150° C.; or ranging from about 50° C. to about 100° C. The fusing process can be conducted at a pressure ranging from about 300 Psi to about 3000 Psi; or ranging from about 300 Psi to about 700 Psi. For comparison, conventional pressure fusers operate at a temperature of about 150° C. to about 200° C. with nip pressure of about 65 Psi to about 150 Psi, depending on conventional fuser design, process speed, and toner material characteristics. Such operating conditions cause conventional fuser materials to degrade and result in short component life and reliability issues.

Figure 1:
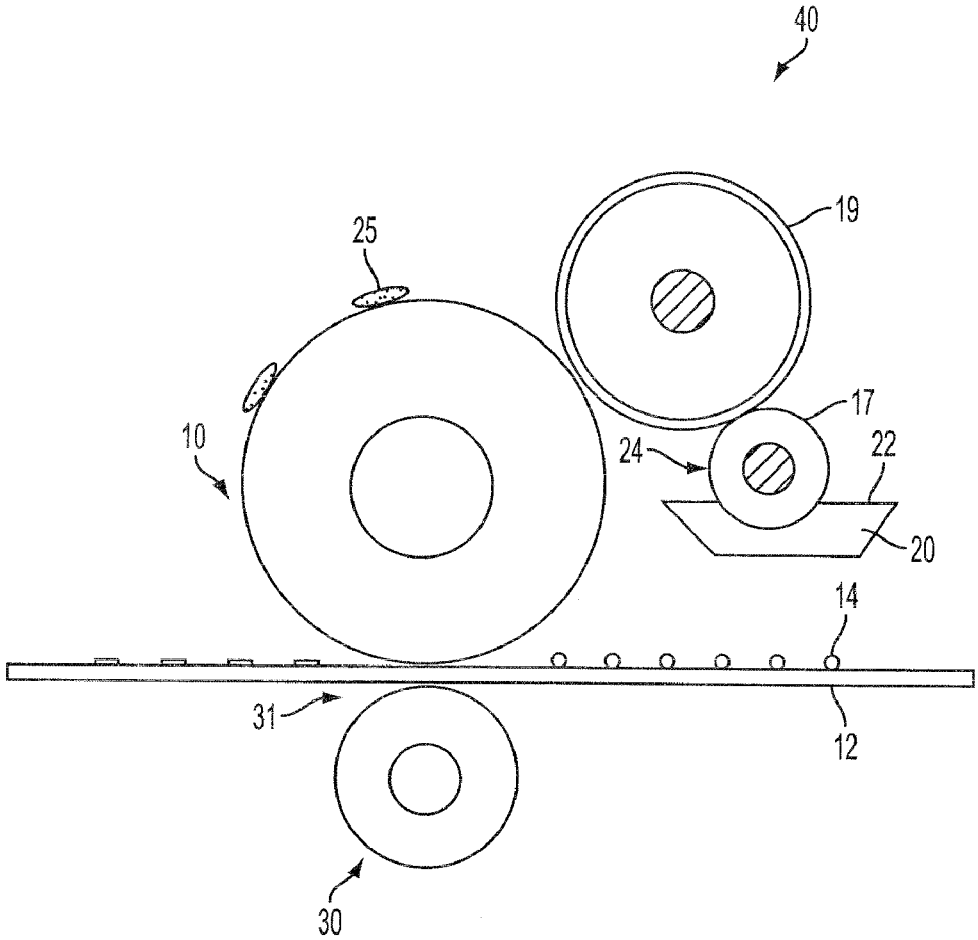
FIG. 1 PRIOR ART
FIG. 1 is a sectional view of a conventional fuser system.

Additionally, use of the low adhesion coating for the fuser member can reduce machine cost and system complexity. For example, the low adhesion coating can enable a toner offset-free fusing. Conventional release oils and complex release management subsystems (see 40 in the conventional fuser system of FIG. 1), which add reliability issues and cost, can thus be virtually removed. Consequently, defects obtained from the conventional release management subsystem itself can be eliminated.

Further, the low adhesion outermost coatings can enable fusing processes with a wax-less toner design for oil-less fusing processes. As known in the art, wax-containing toner is often used to aid release of the toner image in conventional oil-less fusing process. However, wax can be transferred to the fuser surface and thus contaminate the fuser surface, which also affects image quality of a subsequent print. Further more, fused toner images by the low adhesion coating layer can display more desirable gloss characteristics, i.e. higher gloss, with improved gloss uniformity over that achieved with the conventional fuser materials.

In other embodiments, the image fixing system 300 can include, for example, a direct-to-sheet spreader system for ink jet printers, and the image-side member 200A-C, and 200 can be a spreader member in accordance with various embodiments. For similar reasons as those for the above-described fusing system, conventional release management subsystem or oil applicator can be eliminated from the spreader system. Print quality can be improved by using the disclosed low-adhesion materials and systems.

The following examples are illustrative of the present teachings and the advantageous properties, and are not to be taken as limiting the disclosure or claims in any way. In this example, as well as elsewhere in this application, all parts and percentages are by weight unless otherwise indicated.

EXAMPLES

Example 1

Preparation of a Low Adhesion Coating

A low adhesion coating was prepared including about 28.08 grams of Desmophen® A 870 BA, about 10.38 grams of Desmodur® N 3300A, about 2.6 grams of BYK-Silclean® 3700, about 0.15 grams of BYK-331®; about 0.3 grams of BYK-358N®; and about 0.3 grams of catalyst RC-201®. The components were combined and dissolved in a solvent system including about 7 grams of methyl isobutyl ketone, about 7 grams of butyl acetate, and about 7 grams of methyl n-amyl ketone. The resulting coating composition was cast onto a Mylar® sheet. The coating was then cured by heating at a temperature of about 130° C. for about 30 minutes. Contact angles and sliding angles were measured on a 3 by 1 inch coupon fixed on a glass slide.

Example 2

Preparation of a Low Adhesion Coating

A low adhesion coating was prepared including about 28.08 grams of Desmophen® A 870 BA, about 10.38 grams of Desmodur® N 3300A, about 0.6 grams of Fluorolink-D by Solvay Solexix; and about 0.3 grams of catalyst RC-201®. The components were combined and dissolved in a solvent called FCL-52 available from Cytonix Corporation and the resulting coating composition was cast onto a Mylar® sheet. The coating was then cured by heating at a temperature of about 130° C. for about 30 minutes. Contact angles and sliding angles were measured on a 3 by 1 inch coupon fixed on a glass slide.

Example 3

Preparation of a Low Adhesion Coating

A low adhesion coating was prepared including about 28.08 grams of Desmophen® A 870 BA, about 10.38 grams of Desmodur® N 3300A, about 2.6 grams of BYK-Silclean® 3700, about 0.6 grams of Fluorolink-D by Solvay Solexix, and about 0.3 grams of catalyst RC-201®. The components were combined and dissolved in a solvent called FCL-52 available from Cytonix Corporation and the resulting coating composition was cast onto a Mylar® sheet. The coating was then cured by heating at a temperature of about 130° C. for about 30 minutes. Contact angles and sliding angles were measured on a 3 by 1 inch coupon fixed on a glass slide.

Example 4

Fusing Process using Low Adhesion Coatings

Unfused toner patches on paper passed through a fuser nip formed between an anodized Al drum as a pressure roll and a transfix roller (Jupiter hardware), which had an outermost low adhesion coating layer made by the polyurethane-based materials with a siloxane cross-linker as described in Example 1. This polyurethane-based low adhesion layer exhibited a low sliding angle of about 2° with hexadecane, of about 10° with solid ink, and of about 11° with UV ink, indicating low adhesion towards organic materials.

In order to measure the contact angle and the sliding angle, each coating formed in Examples 1-3 was disposed on a separate 3 inch by 1 inch Mylar® sheet, the sheet was affixed onto a glass slide. Contact angle and sliding angle measurements were conducted on an OCA20 goniometer from Dataphysics (San Jose, Calif.), which includes a computer-controlled automatic liquid deposition system, computer controlled tilting stage, and a computer-based image processing system. In a typical static contact angle measurement, test liquid droplets including about 5 or 10 microliters water and hexadecane, about 10 microliter of solid ink, or microliter of UV ink were gently deposited on the testing surface. The static angle was determined by the computer software (SCA20) and each reported data is an average of more than 5 independent measurements. Sliding angle measurements were performed by tilting the base unit at a rate of about 1°/sec with an about-10-microliter-droplet for water, hexadecane, solid ink and UV ink, using titling base unit TBU90E. The sliding angle was defined and measured as the angle where the test liquid droplet starts to slide (or move). For Teflon, a piece from sheet was cut and placed on the goniometer, and the contact angles and sliding angles were recorded as described above. For anodized aluminum, a piece used in Jupiter transfix roll was used for the measurements.

Contact angles and sliding angles of the exemplary low adhesion coatings in Examples 1-3 towards water, hexadecane, solid ink, and ultra-violet curable phase change ink were recorded as given in Table 1, where "CA" denotes contact angle, and "SA" denotes sliding angle.

TABLE 1

| | Water | | Hexadecane | | Solid Ink | | UV ink | |
|---|---|---|---|---|---|---|---|---|
| Coating | CA | SA | CA | SA | CA | SA | CA | SA |
| Anodized aluminum | 12 | flows | 9 | flows | 15 | flows | 13 | flows |
| Teflon | 118 | 64 | 48 | 31 | 63 | >90 | 58 | >90 |
| Example 1 | 100 | 23 | 34 | 2 | 53 | 10 | 41 | 11 |
| Example 2 | 105 | 61 | 67 | 9 | 71 | 13 | 57 | 12 |
| Example 3 | 101 | 51 | 62 | 21 | 65 | 22 | — | — |

As can be seen in Table 1, Examples 1-3 had low sliding angles with hexadecane, solid ink (e.g., at a temperature of about 105° C.), and UV gel ink (e.g., at a temperature of about 75° C.). In addition, hexadecane, solid ink and UV gel ink drops cleanly rolled off from these surfaces without leaving any visible residue, indicating a low adhesion between the coating and each of these test liquid droplets. In contrast, oils like hexadecane, solid ink, and UV ink flow on the surface of conventional anodized aluminum leaving residues, indicating a high adhesion between the conventional aluminum surface and the test liquid droplet. Additionally, solid ink and UV ink remained stuck on Teflon surfaces even at a temperature of about 90°, showing high adhesion between inks and Teflon.

While the coatings in Table 1 exhibited advantageous properties for improving toner release in fusing at time zero, these coatings are required to maintain such properties through many fusing cycles used over the fuser life.

To test the robustness of coatings in Examples 1-3, Crock (cloth) test with Taber® Linear Abraser Model 5700 was performed on the coatings for more than about 1000 cycles. Exemplary results showed that the sliding angle of the coating in Example 1 remained unchanged when measured against hexadecane, solid ink, and UV ink after more than 1000 wipes. Additionally, the coating surface maintained a low sliding angle even after 1000 cleaning cycles with a Crock cloth, where the low sliding angle is from about 1° to less than about 50°, or from about 1° to less than about 30°.

While not intending to be bound by any particular theory, it is believed that low sliding angle for oils along with clean roll-off is a key indicator for low adhesion towards oils like molten toner and ink. Low oil sliding angles, i.e., low oil adhesion, can be an important indicator of anti-offset coatings for low temperature, moderate pressure fusing surfaces.

Example 5

Low Temperature, Moderate Pressure Fusing Process

Figure 4:
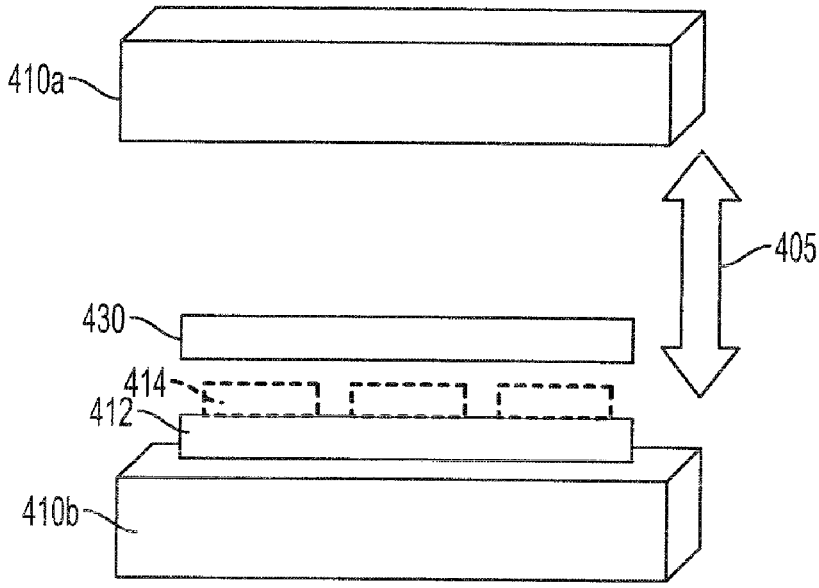
FIG. 4 depicts an exemplary WPF setup in accordance with various embodiments of the present teachings.

An offline static-press fixture was developed to simulate a low temperature, moderate pressure fusing process. FIG. 4 depicts an exemplary static low temperature, moderate pressure fusing setup. As shown, two temperature-controlled metal blocks 410*a-b* were mounted onto a Carver hydraulic press (not shown). The pressure 405 between the blocks 410*a-b* can be controlled by adjusting the hydraulic piston of the exemplary Carver hydraulic press. Unfused toner patches 414 were printed onto paper 412 using a xerographic print engine (not shown). A fusing surface 430 including, for example, the disclosed low adhesion coating or a conventional aluminum surface for comparison purposes, was applied to the toner patches 414. The paper 412 was placed on lower block 410*b* with toner facing up and pre-heated to set temperatures. The fusing surface 430 heated by the top block 410*a* was then pressed down to a required pressure and then removed. The fused toner images were then examined for toner offset and gloss.

Several types of toners were used in the tests including emulsion aggregation (EA) toner, EA low melt toner, and both a wax-containing and a wax-less model EA toner. The offline test was preformed using static press with metal blocks 410*a-b* controlled in temperature and pressure.

Example 6

Fusing Results for Conventional Al Fuser Member

In an oil-less fusing process, Al fuser rolls were used to fix toner patches including wax-containing EA toner at a temperature ranging from about 50° C. to about 100° C. and at a pressure ranging from about 300 Psi to about 2000 Psi. Large toner offset (not illustrated) occurred to the Al surface. Release oils were applied to the Al surface to prevent toner offset as known in the art.

With the release oil applied, Al fuser rolls were used to fix toner patches including wax-containing EA-HG toner, toner offset to the Al surface still occurred at a temperature higher than 75° C. Specifically, white patches with no toner images were observed on paper, meaning a printing failure. Moreover, large offset to Al fuser surface was observed even when wax-free toner materials were used.

Example 7

Fusing Results for Fuser Member Having Low Adhesion Coating of Example 1

The low adhesion coating in Example 1 was used in the fusing process as shown in FIG. 4. The fusing process was performed at a temperature of about 75° C., 85° C., and 90° C. and at a pressure of about 450 Psi. As a result, even with wax-less EA toner materials, no toner offset was observed onto the low adhesion coating surface indicating an offset-free fusing process. Additionally, no release oil was needed and used when the low adhesion coating was applied to the fuser member.

Further, toner images fused by using the low adhesion coating but without using the release oil (i.e., oil-less) displayed much superior gloss characteristics having improved gloss uniformity and higher gloss level than those fused using conventional Al fuser member with release oil applied as in Example 6.

Table 2 compares gloss values of toner images between using aluminum fuser surface and low adhesion coating surface of Example 1 using the low temperature, moderate pressure static setup as shown in FIG. 4.

TABLE 2

| 75° C. Micro-Gloss | | | | |
|---|---|---|---|---|
| Toner patch | EA fused at 75° C./450 Psi Example 1 | | EA fused at 85° C./450 Psi Example 1 | |
| composition | Al with Oil | - No Oil | Al with Oil | - No Oil |
| 100% M/Y | 60.1 | 97.3 | 66.2 | 91.5 |
| 75% M/Y | 58.6 | 83.4 | 64.1 | 82.1 |
| 50% M/Y | 41.5 | 51.5 | 51.1 | 63.1 |

As indicated by Table 2, toner images fused with low adhesion coatings had higher gloss than those with the Al surfaces. This gloss improvement provided improved release properties and thus extended offset latitude.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein.

While the present teachings have been illustrated with respect to one or more implementations, alterations and/or modifications can be made to the illustrated examples without departing from the spirit and scope of the appended claims. In addition, while a particular feature of the present teachings may have been disclosed with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising."

Further, in the discussion and claims herein, the term "about" indicates that the value listed may be somewhat altered, as long as the alteration does not result in nonconformance of the process or structure to the illustrated embodiment. Finally, "exemplary" indicates the description is used as an example, rather than implying that it is an ideal.

Other embodiments of the present teachings will be apparent to those skilled in the art from consideration of the specification and practice of the present teachings disclosed herein. It is intended that the specification and examples be considered as exemplary only, with a true scope and spirit of the present teachings being indicated by the following claims.

What is claimed is:

1. An image fixing system comprising:

an image-side member comprising, a substrate, and an outermost layer disposed over the substrate; wherein the outermost layer comprises a low adhesion coating having a low sliding angle ranging from about 1° to about 30° with at least one material selected from the group consisting of a solid ink, a toner, hexadecane and water; and a pressure member configured in contact with the image-side member to pass a print medium there-between and to fix an image on the print medium, wherein the contact between the image-side member and the pressure member has a nip pressure from about 300 Psi to about 3000 Psi at a temperature from about 50° C. to about 150° C.

2. The system of claim 1, wherein the low adhesion coating has a contact angle at least about 30° with hexadecane.

3. The system of claim 1, wherein the low adhesion coating has a contact angle at least about 90° with water.

4. The system of claim 1, wherein the low adhesion coating has a contact angle at least about 40° with the solid ink or the toner.

5. The system of claim 1, wherein the low adhesion coating is stable at a temperature of about 200° C. or less.

6. The system of claim 1, wherein the contact between the image-side member and the pressure member has a nip pressure is from about 300 Psi to about 2000 Psi at a temperature from about 50° C. to about 100° C.

7. The system of claim 1, wherein the image-side member is a fuser member configured in an oil-less fusing system to fix an unfixed toner image on the print medium;

wherein each of the unfixed toner image and the toner comprises a wax-containing toner or a wax-less toner and has the low sliding angle with the low adhesion coating.

8. The system of claim 1, wherein the image-side member is a spreader member configured in a direct-to-sheet spreader system for an oil-less spreading of an unfixed jetted ink image on the print medium, wherein each of the jetted ink image and the ink has the low sliding angle with the low adhesion coating and comprises an ultra-violet gel ink, a solid ink, a phase-change ink, or an aqueous-based ink.

9. The system of claim 1, wherein the low adhesion coating comprises:

a polymer or oligomer containing an isocyanate functional group;

a polymer or oligomer containing a hydroxyl functional group;

a hydroxyl functionalized polymer or oligomer, containing at least one polysiloxane unit; and optionally, a hydroxyl functionalized fluoro-crosslinking material.

10. The system of claim 9, wherein the polymer or oligomer containing the isocyanate functional group is selected from the group consisting of diphenylmethane diisocyanate, toluene-diisocyanate, hexamethylene diisocyanate, hexamethylenediisocyanate trimer, benzene 1,4-diisocyanate, isophorone diisocyanate, a polymer or oligomer containing isocyanate (—NCO) functional groups, and mixtures thereof.

11. The system of claim 9, wherein the polymer or oligomer containing a hydroxyl functional group comprises a hydroxyl functional polyacrylate, a hydroxyl functional polymethacrylate, a hydroxyl functional styrene, or a hydroxyl functional polyester.

12. The system of claim 9, wherein the hydroxyl functionalized polymer or oligomer containing at least one polysiloxane unit comprises a hydroxyl-functional silicone modified polyacrylate comprising Silclean 3700.

13. The system of claim 9, wherein the hydroxyl functionalized fluoro-crosslinking material comprises Fluorolink-D, Fluorolink-D10H, Fluorolink-D10, Fluorolink-E10, or Fluorolink-E10H.

14. The system of claim 1, wherein the low adhesion coating comprises an isocyanate, a polylol, and a hydroxyl functionalized fluoro-crosslinking material, wherein the isocyanate is selected from the group consisting of diphenylmethane diisocyanate, toluene diisocyanate, hexamethylene diisocyanate, hexamethylenediisocyanate trimer, benzene 1,4-diisocyanate, isophorone diisocyanate, or a polymer or oligomer containing an isocyanate (—NCO) functional group, and a mixture thereof;

wherein the polyol comprises a hydroxyl functional group and is selected from the group consisting of a hydroxyl functional polyacrylate, a hydroxyl functional polymethacrylate, a hydroxyl functional styrene, a hydroxyl functional polyester, and a mixture thereof; and wherein the hydroxyl functionalized fluoro-crosslinking material is selected from the group consisting of Fluorolink-D, Fluorolink-D10H, Fluorolink-D10, Fluorolink-E10, Fluorolink-E10H, and a mixture thereof.

15. The system of claim 1, wherein the substrate of the image-side member is formed of a material selected from the group consisting of aluminum, anodized aluminum, steel, nickel, copper, polyimide, silicone, polyester, polyetheretherketone (PEEK), poly(arylene ether), polyamide, and a mixture thereof.

16. The system of claim 1, wherein the image-side member is in a form comprising a cylinder, a roll, a belt, a plate, a film, a sheet, a drum, or a drelt.

17. The system of claim 1, wherein the pressure member comprises a steel substrate and a low adhesion coating disposed over the steel substrate as an outermost layer; and wherein the low adhesion coating has a low sliding angle of less than about 1° to less than about 30° with one or more of a solid ink, a toner, hexadecane and water.

18. The system of claim 1, wherein the image-side member comprises one or more of a resilient layer and an intermediate layer, disposed between the low adhesion coating and the substrate.

19. An image fixing system comprising:

a low temperature, moderate fuser member comprising, a substrate, and an outermost layer disposed over the substrate; wherein the outermost layer comprises a low adhesion coating having a low sliding angle ranging from about 1° to about 30° with a toner comprising a wax-containing toner or a wax-less toner; and a pressure member configured in contact with the low temperature, moderate fuser member to pass a print medium there-between and to fix an image on the print medium, wherein the contact between the pressure member and the low temperature, moderate fuser member has a nip pressure ranging from about 300 Psi to about 3000 Psi at a temperature of about 150° C. or less.

20. An image fixing system comprising:

a spreader member comprising, a substrate, and an outermost layer disposed over the substrate; wherein the outermost layer comprises a low adhesion coating having a low sliding angle ranging from about 1° to about 30° with an ink; and a pressure member configured in contact with the spreader member to pass a print medium there-between and to fix an image on the print medium, wherein the contact between the pressure member and the spreader member has a nip pressure ranging from about 300 Psi to about 3000 Psi at a temperature of about 150° C. or less.

* * * * *